US007704045B1

(12) United States Patent
Liang

(10) Patent No.: US 7,704,045 B1
(45) Date of Patent: Apr. 27, 2010

(54) TURBINE BLADE WITH BLADE TIP COOLING NOTCHES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 552 days.

(21) Appl. No.: 11/799,660

(22) Filed: May 2, 2007

(51) Int. Cl.
*F01D 5/12* (2006.01)

(52) U.S. Cl. ..... 416/92; 416/228

(58) Field of Classification Search ..... 416/92, 416/228; 415/173.1
See application file for complete search history.

(56) References Cited

U.S. PATENT DOCUMENTS 4,390,320 A 6/1983 Eiswerth
5,192,192 A * 3/1993 Ourhaan ..... 416/97 R
5,282,721 A 2/1994 Kildea
6,224,336 B1 5/2001 Kercher
6,382,913 B1 5/2002 Lee et al.
6,494,678 B1 * 12/2002 Bunker ..... 416/97 R
6,602,052 B2 8/2003 Liang
6,971,851 B2 12/2005 Liang
6,991,430 B2 1/2006 Stec et al.
2006/0088420 A1 * 4/2006 Lee ..... 416/235

* cited by examiner

*Primary Examiner*—Richard Edgar
(74) *Attorney, Agent, or Firm*—John Ryznic

(57) ABSTRACT

A turbine rotor blade for use in a gas turbine engine, the rotor blade including a squealer pocket on the blade tip to provide a seal between the blade tip and the outer shroud of the engine. A row of film cooling holes extend along the pressure side wall and the suction side wall of the blade near the tip and discharge film cooling air up and over the blade tip. Associated with each of the film cooling holes is a notch formed on the edge of the tip rail in which each notch is located above a film cooling hole and functions to collect and accelerate the cooling air discharged from the film cooling hole up and into the blade tip. The notches reduce the effective thickness of the blade tip in order to reduce the heat load, and increase the effective convection surface area for the cooling air flow. The notches also function to maintain the film layer of cooling air over the blade tip longer than in the prior art without the notches.

10 Claims, 5 Drawing Sheets

TURBINE BLADE WITH BLADE TIP COOLING NOTCHES

BACKGROUND OF THE INVENTION

1. Field of the Invention

The present invention relates generally to fluid reaction surfaces, and more specifically to a turbine blade with tip cooling.

2. Description of the Related Art Including Information Disclosed Under 37 CFR 1.97 and 1.98

In a gas turbine engine, especially an industrial gas turbine engine, the turbine section includes a plurality of stages of turbine rotor blades with blade tips that from a gap with an outer shroud of the engine in which the hot gas flow passing through the turbine can leak past. The blade tip gap leakage not only reduces the efficiency of the turbine by not impacting all of the gas flow onto the turbine rotor blades, but can cause thermal damage to the blade tips and result in shortened life for the blades.

In a high temperature turbine blade tip section, the heat load is a function of the blade tip leakage flow. A high leakage flow will induce a high heat load onto the blade tip section. Thus, blade tip section sealing and cooling must be addressed as a single problem. In the prior art, a turbine blade tip includes a squealer tip rail that extends around the perimeter of the airfoil flush with the airfoil wall and forms an inner squealer pocket. The main purpose of using a squealer tip in a blade design is to reduce the blade tip leakage and also to provide the rubbing capability for the blade.

In the prior art, blade tip cooling is accomplished by drilling holes into the upper extremes of the serpentine coolant passages from both the pressure and suction surfaces near the blade tip edge and the top surface of the squealer cavity. In general, film cooling holes are located along the airfoil pressure side and suction side tip sections and from the leading edge to the trailing edge to provide edge cooling for the blade squealer tip. In addition, convective cooling holes are also located along the tip rail at the inner portion of the squealer pocket to provide for additional cooling for the squealer tip rail. Since the blade tip region is subject to severe secondary flow field, a large quantity of film cooling holes and cooling flow is required in order for adequate cooling of the blade tip periphery.

FIG. 1 shows a prior art rotor blade squealer tip cooling design with the secondary hot gas flow migration around the blade tip section. The squealer tip pocket is formed by the pressure side and the suction side walls and the pocket floor. Film cooling holes are shown on the pressure side wall just beneath the squealer tip edge. Cooling holes are shown on the pocket floor to discharge cooling air from the internal cooling air passage and into the squealer pocket. The airflow over the blade tip flows in a vortex pattern as indicated by the arrows. FIGS. 2 and 3 shows the pressure side film cooling hole arrangement and shape of each film cooling hole opening. FIGS. 4 and 5 shows the suction side film cooling hole arrangement and shape of each film cooling hole opening.

The blade squealer tip rail is subject to heating from three exposed sides which are heat load form the airfoil hot gas side surface of the tip rail, heat load from the top portion of the tip rail, and heat load from the back side of the tip rail. Cooling of the squealer tip rail by means of discharge row of film cooling holes along the blade pressure side and suction side peripheral and conduction through the base region of the squealer tip becomes insufficient. This is primarily due to the combination of squealer pocket geometry and the interaction of hot gas secondary flow mixing. The effectiveness induced by the pressure film cooling and the tip section convective cooling holes becomes very limited.

U.S. Pat. No. 6,494,678 B1 issued to Bunker on Dec. 17, 2002 and entitled FILM COOLED BLADE TIP discloses a turbine rotor blade with a tip having multi-channel cooling grooves (#50 in the Bunker patent) arranged along the tip edge on the pressure side wall of the blade and discharge cooling air from an internal cooling channel of the blade. These cooling holes and channels do not collect and accelerate the cooling air as in the present invention.

It is therefore an object of the present invention to provide for a turbine rotor blade with film cooling holes for the blade tip edge periphery that greatly reduces the airfoil tip edge metal temperature and therefore reduces the cooling flow requirement and improve turbine efficiency.

It is another object of the present invention to provide for a turbine rotor blade with film cooling holes for the blade tip edge periphery that will provide for a film of cooling air to pass over the blade tip.

It is another object of the present invention to provide for a turbine rotor blade with notches on the pressure side tip edge that will retain the cooling air longer in the notches.

It is another object of the present invention to provide for a turbine rotor blade with increased tip section cooling side convection wedded surface area.

It is another object of the present invention to provide for a turbine rotor blade with a blade tip with reduced hot side convective area.

It is another object of the present invention to provide for a turbine rotor blade with a blade tip that will reduce the effective leakage flow effective area which reduces leakage flow and thus lowers the heat load onto the blade tip.

BRIEF SUMMARY OF THE INVENTION

A turbine rotor blade for use in a gas turbine engine, the turbine blade including a row of pressure side film cooling holes just below the tip edge and a row of suction side film cooling holes just below the tip edge, and a row of notches formed on the edge of the squealer tip on the pressure side and a row of notches formed on the edge of the suction side of the blade tip. The pressure side and suction side film cooling holes discharge film cooling air in an upward direction toward the tip edge. Just above the film cooling holes are the notches which have a concave shape with a narrow downstream portion and a wider upstream portion that opens on the side of the tip edge and the top of the tip edge. One notch is associated with one of the film cooling holes such that film cooling air exiting a hole passes into the notch while maintaining a film layer of cooling air over the tip edge. The film cooling air form the holes are retained within the respective notches.

DETAILED DESCRIPTION OF THE INVENTION

Figure 6:
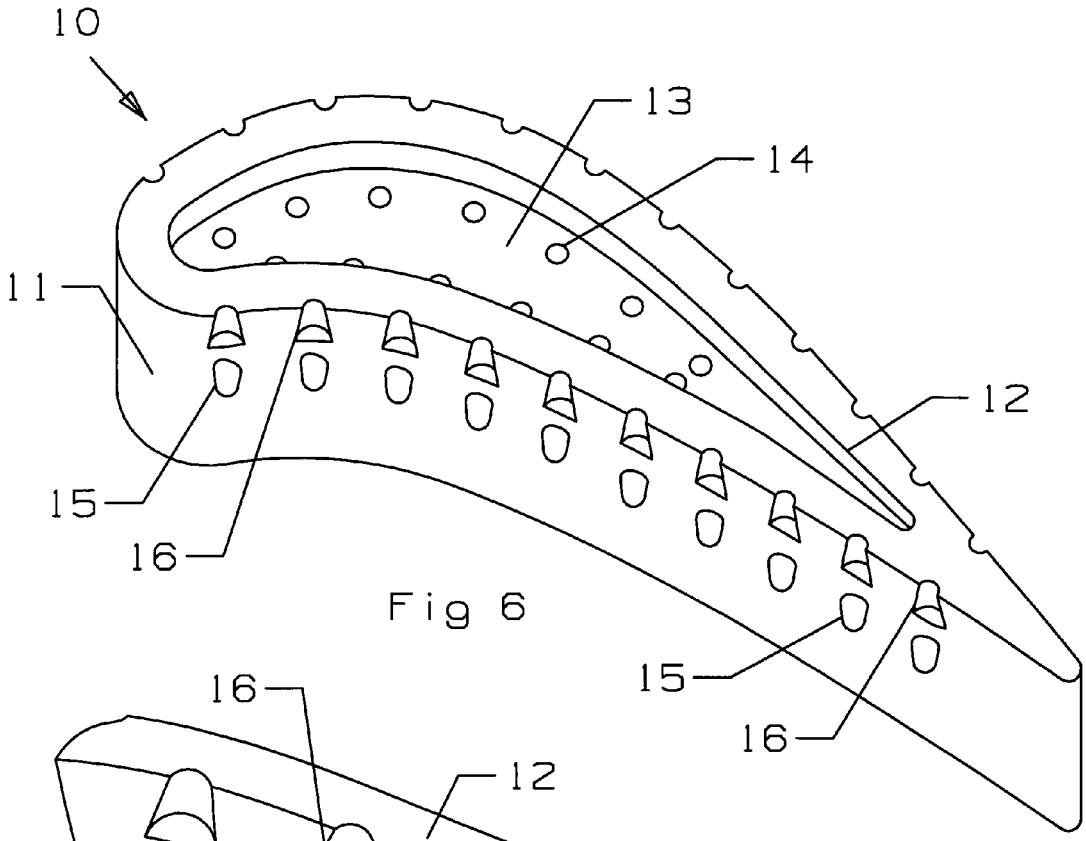
FIG. 6 shows the turbine blade with the cooling holes and notches of the present invention.
Figure 7:
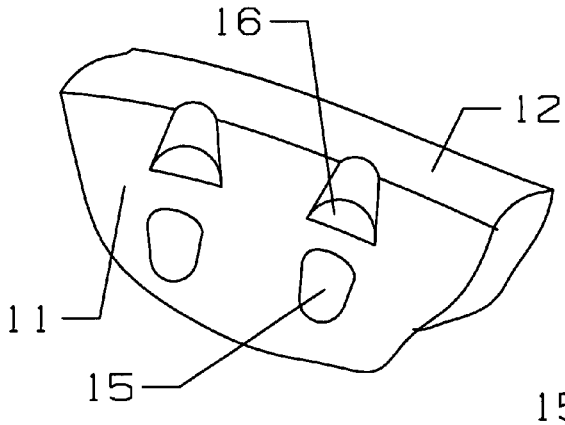
FIG. 7 shows a detailed view of the film cooling holes and notches of the present invention.
Figure 8:
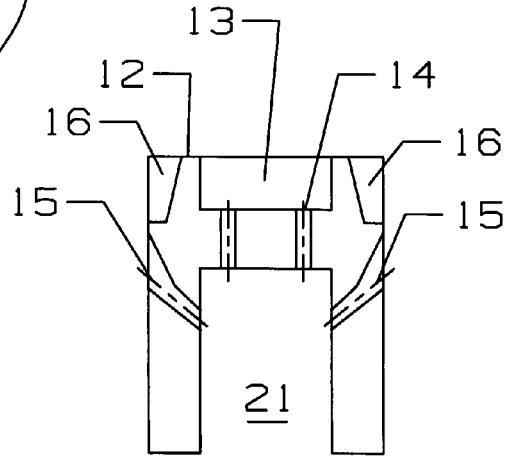
FIG. 8 shows a cross section view along the chordwise direction of the turbine blade of the present invention.

The present invention is directed to the cooling hole arrangement for rotor blade tips used in a gas turbine engine. The concept of the present invention is represented in FIGS. 6 through 8 where FIG. 6 shows a view of the blade tip region of a rotor blade. The blade 10 is a rotor blade used within the turbine section of the engine and requires cooling in order to provide the higher efficiency that a non-cooled blade would. The rotor blade 10 includes a pressure side wall 11 and a suction side wall, a tip rail 12 extending around the entire blade tip and forming a squealer pocket 13 with pocket convective cooling holes 14 to provide cooling air to the pocket 13. An internal cooling supply channel 21 delivers cooling air to the film cooling holes 15 and the convective cooling holes 14 in the squealer pocket 13. On the outer edges of the blade tip is a row of film cooling holes 15 extending on the pressure side wall and the suction side wall of the blade. Above each film cooling hole 15 is a notch 16 in which the cooling air discharged from the associated film cooling hole below will flow through in order to maintain the film of cooling air flowing over the blade tip. Each notch 16 opens onto the side wall of the blade and on the tip surface 12 as seen best in FIG. 8. Each notch 16 slants away from the side wall and also decreases in width from the bottom of the notch to the top where the notch opens onto the tip surface 12. The notch opening on the tip surface 12 has a half circle cross sectional shape as seen in FIG. 7. The notch has a frontal cross sectional width on the lower or upstream end with a width equal to or greater than the width of the frontal cross sectional width of the upper or downstream end of the film cooling hole 15. In FIG. 7, the width of the bottom end of the notch 16 on the surface of the airfoil wall is equal to or greater than the width of the top end of the film cooling hole 15.

Figure 1:
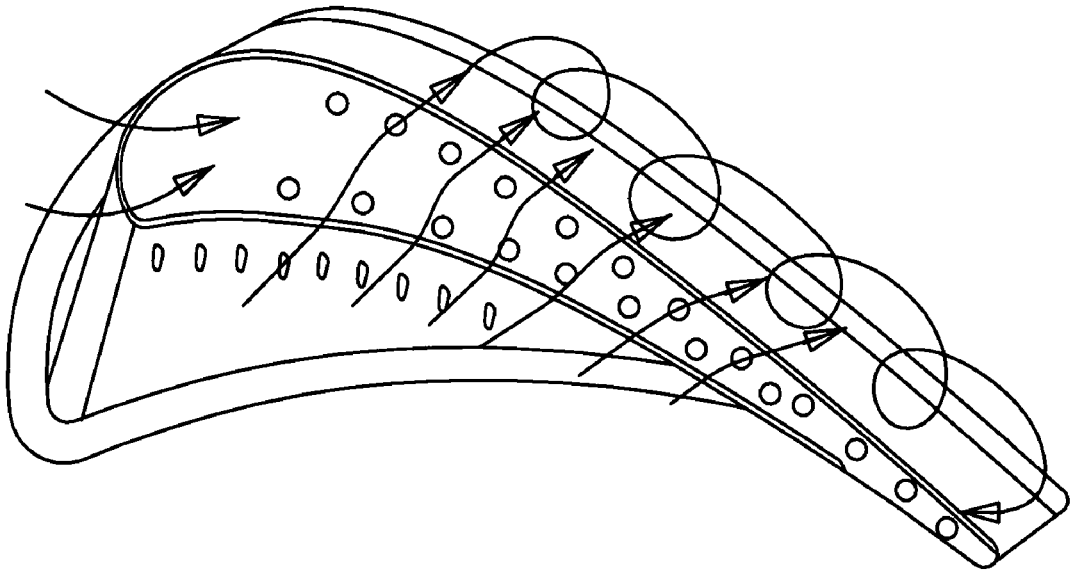
Fig 1 Prior Art
FIG. 1 shows a Prior Art turbine rotor blade tip with secondary flow and cooling pattern.
Figure 2:
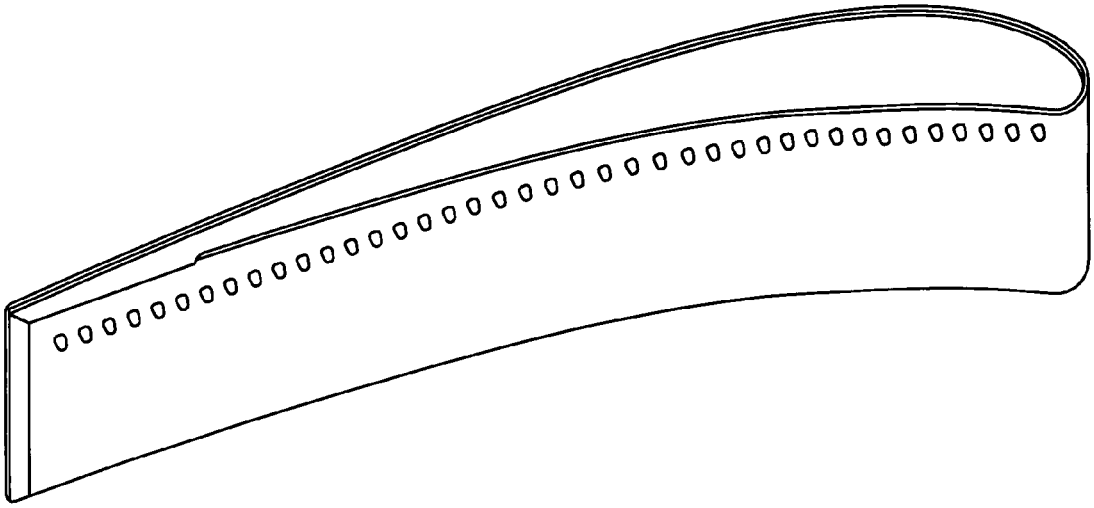
Fig 2 Prior Art
FIG. 2 shows a Prior Art turbine blade with pressure side cooling holes.
Figure 3:
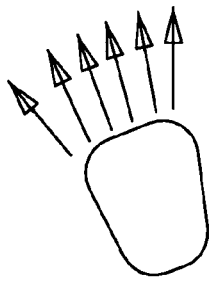
Fig 3 Prior Art
FIG. 3 shows a detailed view of the cooling hole of the FIG. 2.
Figure 4:
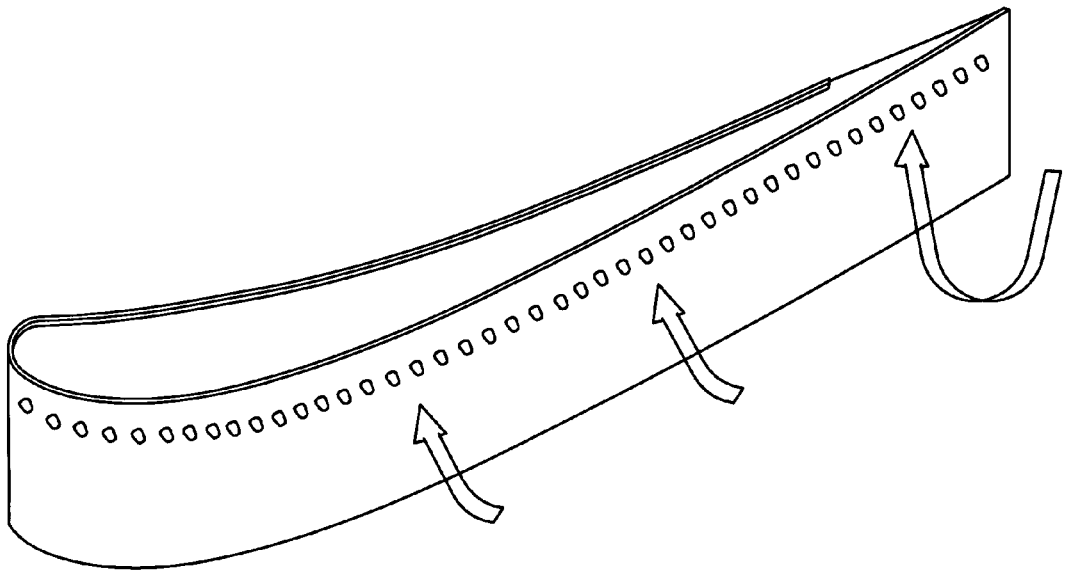
Fig 4 Prior Art
FIG. 4 shows a Prior Art turbine blade with suction side cooling holes.
Figure 5:
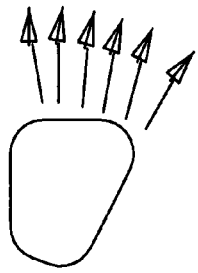
Fig 5 Prior Art
FIG. 5 shows a detailed view of the cooling hole of the FIG. 4.

The film cooling holes 15 on the pressure and suction side walls of the blade slant upward as seen in FIG. 8 and have an opening with a cross sectional shape as seen in FIGS. 3 and 5 in order to produce a film layer of cooling air that flows over the blade tip edges. With the addition of the notches 16 of the present invention in association with a respective film cooling hole 15, the film layer of cooling air does not break up as fast as in the prior art designs. Also, the notches provide for increased heat flow from the metal of the blade tip to the cooling air. The notches 16 also reduce the effective thickness for the blade crown and therefore increase the effectiveness of the backside convection cooling.

Figure 9:
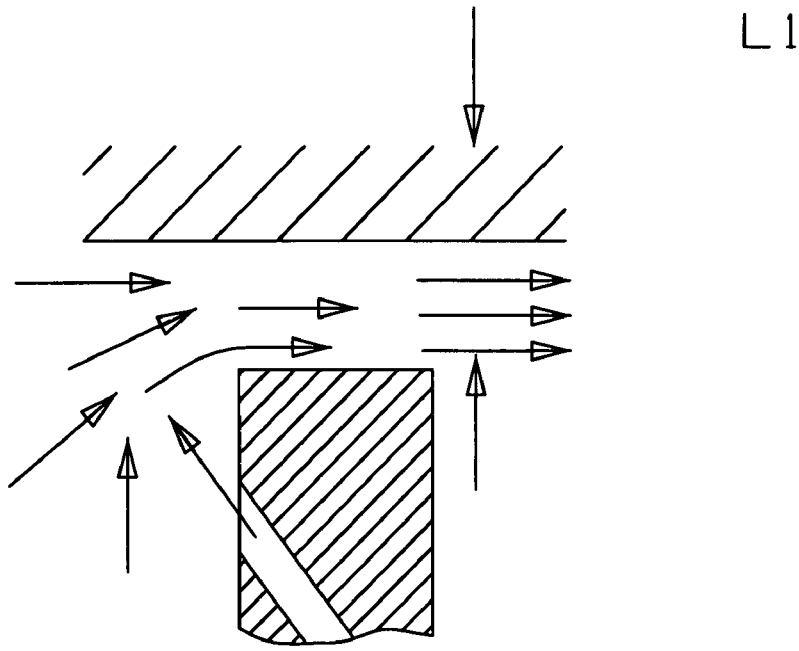
Fig 9 Prior Art
FIG. 9 shows a blade tip flow for a Prior Art design.
Figure 10:
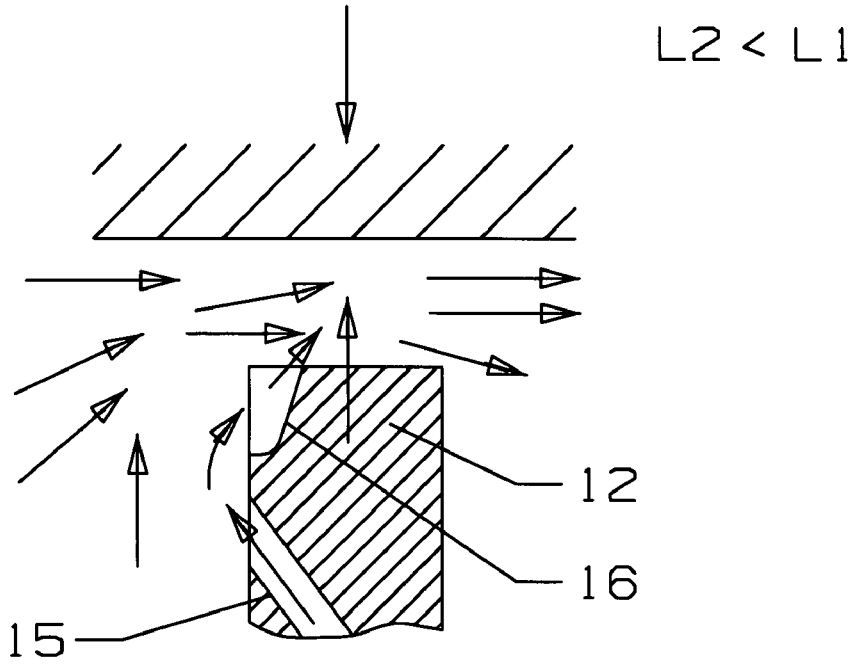
FIG. 10 shows a blade tip flow for the present invention.

The notches are shaped and sized for several purposes related to the cooling of the blade tip. The notches 16 provide a larger convective area around the blade tip edge to produce greater heat transfer. The notches allow for the film layer to remain longer and farther over the blade tip. The notches also reduce the heat load area of the tip. The size and shape of the notches are such that the notches will catch the flow from the film cooling holes 15 and accelerate the flow over the tip to reduce the leakage flow area between the outer shroud and the blade tip. FIGS. 9 and 10 show the difference between the present invention that uses the notches and the prior art that do not use a notch. In FIG. 9, the hot gas flow through the turbine converges upstream of the gap formed between the stationary outer shroud and the blade tip. Cooling air discharged from the film cooling hole pushes the hot gas flow up and over the blade tip as seen in FIG. 9. The leakage flow over the tip has an effective leakage gap length represented by the distance L1 in FIG. 9.

FIG. 10 represents the flow using the notches of the present invention. The hot gas flow through the turbine converges upstream of the blade tip as in the prior art FIG. 9 flow pattern. With the notch, the cooling air discharged from the film cooling hole will gather within the notch and accelerate upward and toward the downstream direction of the hot gas flow as seen in FIG. 10. This accelerated cooling air flow through the notch will act to push the hot gas flow upward further than in the Prior Art FIG. 9 design. Thus, the effective leakage flow area as represented in FIG. 10 by the distance L2 will be shorted than in the prior art distance L1. Because the effective leakage flow area for the blade tip is less, the leakage flow over the blade tip will be less. Less leakage flow results in less heat generated on the tip and a more efficient turbine.

Locating the notches 16 above the film cooling holes 15 will allow for the film cooling air exiting the holes to flow in the same direction of the vortex flow over the blade tip from the pressure side wall to the suction side wall. The notches 16 in the blade tip also increases the tip section cooling side surface area and reduce the hot gas convective surface area from the tip crown and therefore reduces the heat load from the tip crown.

I claim the following:

1. A turbine rotor blade for use in a gas turbine engine, the blade comprising:

a pressure side wall and a suction side wall, and a leading edge and a trailing edge;

a blade tip forming a gap between an outer shroud of the engine;

a plurality of notches formed on an edge of the blade tip on the pressure side wall, the notches opening onto the pressure side wall and the blade tip; and, a plurality of film cooling holes opening onto the pressure side wall and just below the plurality of notches so that the film cooling air discharged from the film cooling holes will flow into the notches, the notches being sized and shaped to collect and accelerate cooling air toward the blade tip to reduce leakage across the gap.

2. The turbine rotor blade of claim 1, and further comprising:

each of the notches is associated with one of the film cooling holes.

3. The turbine rotor blade of claim 1, and further comprising:

the plurality of notches each have a back side that slants in the downstream direction of the hot gas flow, and have a frontal cross sectional shape that decreases in width toward the blade tip.

4. The turbine rotor blade of claim 3, and further comprising:

the plurality of notches each have a cross sectional shape on the tip surface that is substantially a half circle.

5. The turbine rotor blade of claim 1, and further comprising:

a plurality of notches formed on an edge of the blade tip on the suction side wall, the notches opening onto the suction side wall and the blade tip; and, a plurality of film cooling holes opening onto the suction side wall and just below the plurality of notches so that the film cooling air discharged from the film cooling holes will flow into the suction wall side notches.

6. The turbine rotor blade of claim 1, and further comprising:

the blade includes a squealer tip with a tip rail extending around the airfoil tip surface; and, the plurality of notches are formed in the tip rail along the edge.

7. The turbine rotor blade of claim 1, and further comprising:

The plurality of notches each have a width on the upstream end greater than the width of the film cooling hole associated with the notch.

8. A process for reducing a leakage across a blade tip in a gas turbine engine, the engine including a rotor blade with a row of pressure side film cooling holes to discharge cooling air toward a gap formed between the blade tip and an outer shroud, the process comprising the steps of:

discharging the cooling air from the film cooling holes in a direction having an upward component;

collecting cooling air discharged from the film cooling holes in a notch opening onto the pressure side of the blade tip edge just above the film cooling holes; and, accelerating the cooling air in the notch out through an opening onto the blade tip surface such that the leakage flow across the blade tip is reduced.

9. The process for reducing a leakage across a blade tip of claim 8, and further comprising the step of:

discharging cooling air form the notch in a direction having a downstream component.

10. The process for reducing a leakage across a blade tip of claim 9, and further comprising the step of:

collecting cooling air within a plurality of notches in which each notch is associated with a separate film cooling hole such that a film layer of cooling air passes over the edge of the blade tip.

* * * * *